US007739774B2

(12) United States Patent
Hösel

(10) Patent No.: US 7,739,774 B2
(45) Date of Patent: Jun. 22, 2010

(54) APPARATUS ON A SPINNING PREPARATION MACHINE, FOR EXAMPLE, A DRAW FRAME, FLAT CARD, COMBING MACHINE OR THE LIKE, HAVING AT LEAST TWO DRIVEN DRAFTING SYSTEMS

(75) Inventor: Fritz Hösel, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 160 days.

(21) Appl. No.: 12/149,456

(22) Filed: May 1, 2008

(65) Prior Publication Data

US 2008/0295293 A1 Dec. 4, 2008

(30) Foreign Application Priority Data

Jun. 4, 2007 (DE) ..... 10 2007 026 158

(51) Int. Cl.
*D01H 5/18* (2006.01)

(52) U.S. Cl. ..... 19/293

(58) Field of Classification Search ..... 19/236, 19/258, 293

See application file for complete search history.

(56) References Cited

U.S. PATENT DOCUMENTS 4,480,355 A * 11/1984 Vignon et al. ..... 19/236
4,757,677 A 7/1988 Smith et al.
5,015,938 A 5/1991 Oehler et al.
5,426,353 A * 6/1995 Stuhr et al. ..... 318/15

FOREIGN PATENT DOCUMENTS

| | | |
|---|---|---|
| DE | 24 46 429 B2 | 1/1977 |
| DE | 31 33 436 A1 | 3/1983 |
| DE | 31 33 437 A1 | 3/1983 |
| EP | 0 392 255 A3 | 3/1990 |

OTHER PUBLICATIONS

German Patent and Trademark Office Search Report, dated Oct. 11, 2007, issued in connection with counterpart German Application No. 10 2007 026 158.8.

UK Intellectual Property Office Search Report, dated Aug. 12, 2008, issued in connection with counterpart British Application No. GB0809941.8.

* cited by examiner

*Primary Examiner*—Shaun R Hurley
(74) *Attorney, Agent, or Firm*—Venable LLP; Robert Kinberg; Justine A. Gozzi

(57) ABSTRACT

In the case of an apparatus on a spinning preparation machine, e.g. a draw frame, flat card, combing machine or the like, in particular a double-head draw frame, with at least two driven drafting systems having force-transmitting means for driving drafting rollers of the drafting systems and at least one drive motor, a coupling is present between a drive motor and a drive shaft. To allow the effectiveness and efficiency to be substantially increased in a structurally simple and cost-effective manner, the respective drive chains are connected via a respective controllable coupling to the motor and the rotational speed of the motor can be reduced for the engagement and disengagement process.

20 Claims, 8 Drawing Sheets

APPARATUS ON A SPINNING PREPARATION MACHINE, FOR EXAMPLE, A DRAW FRAME, FLAT CARD, COMBING MACHINE OR THE LIKE, HAVING AT LEAST TWO DRIVEN DRAFTING SYSTEMS

CROSS REFERENCE TO RELATED APPLICATION

This application claims priority from German Patent Application No. 10 2007 026 158.8 dated Jun. 4, 2007, the entire disclosure of which is incorporated herein by reference.

BACKGROUND OF THE INVENTION

The invention relates to an apparatus on a spinning works preparation machine, e.g. a draw frame, flat card, combing machine or the like, in particular a double-head draw frame.

In the textile industry, draw frames are often used to even out the card sliver. A very simple and cost-effective variant is a machine having two drafting systems working in parallel, what is known as a double-head draw frame. In these machines, which inter alia have two feed creels and two can coilers or can changers, the working elements of the two sides are driven in each case by a common drive. The result of this, however, is that in the event of a fault on one of the two sides, both sides have to be shut down. This in turn means that although the looms are relatively cost-effective, the achievable efficiency compared with other looms is very low.

A double-head draw frame is known from DE-A-31 33 436, in which a motor drives a variable speed gear mechanism and a releasable, electrically operable coupling is arranged between the driving belt pulley of the variable speed gear mechanism and the main shaft. In the event of a fault, the motor is switched off, the coupling is activated and a brake is engaged. Through the coupling, the brake needs to decelerate only the main shaft and elements driven thereby, and not the motor with its relatively large inertia. In this apparatus, the two heads of the draw frame are mechanically coupled rigidly to one another. They may be isolated from the drive motor by means of the coupling, but only both at the same time. In the event of a fault in one of the draw frame heads, there is no provision in DE-A-31 33 436, and it is also impossible with the known device, to allow the other draw frame head to continue production. The effectiveness and efficiency is in that way limited in the known apparatus. In addition, only one coupling is provided.

SUMMARY OF THE INVENTION

It is an aim of the invention to produce an apparatus of the kind described initially, which avoids or mitigates the said disadvantages, which is in particular of simple construction and inexpensive, and permits the effectiveness and efficiency to be considerably increased.

The invention provides an apparatus on a spinning preparation machine, having:

- a first driven drafting system for drafting at least one fibre sliver with drafting rollers, and having at least one force-transmitting element for driving the drafting rollers of the first drafting system;
- a second driven drafting system for drafting at least one fibre sliver with drafting rollers and having at least one force-transmitting element for driving the drafting rollers of the second drafting system; and
- at least one drive motor;

wherein a force-transmitting element for the first drafting system and a force-transmitting element for the second drafting system are connected via a respective coupling to a said drive motor and the rotational speed of the motor can be reduced for engagement and disengagement of the couplings.

The features according to the invention enable the efficiency to be quite considerably increased in a simple manner. Particular advantages are that in a double-head draw frame a respective common variable-speed drive can be used for the individual functions and the drive trains of the left-hand and right-hand sides are connected to the motor via two controllable couplings. In this way it is possible, if required, to shut down (disengage) one side of the machine and yet to continue production with the other side. To achieve a relatively smooth transition upon engagement and disengagement, the rotational speed of the motor can be automatically reduced for this procedure and subsequently accelerated again.

The invention can produce the following further advantages:

- The delivery speed and the main draft can be infinitely variable without the reversal of belts or the like.
- The option of being able, if required, to separate the drive chains (couplings), enables the efficiency and the productivity of the machine to be considerably increased and these properties to approach those of a single-head draw frame.
- If activation of the couplings is pulsed, it is possible to produce a smooth speed transition, above all during re-engagement.
- Because the rotational speed of the drive motor can be reduced at every engagement and disengagement process, a smooth speed transition is possible.

The apparatus according to the invention may be used for virtually all drive configurations. This applies to double-head draw frames with just a single motor, to those with a main and a servomotor or to draw frames with a main motor and a gear mechanism (to produce the draft). Moreover, it may be used in the case of motors with and without speed adjustment. In addition, combinations are possible, e.g. variable-speed main motor and variable-speed servomotor. The invention may also be used for the drive of the can turntable.

Advantageously, in the event of a problem in one of the two working heads, the corresponding drive chains can be isolated from the motors by means of the controllable couplings and, after correcting the problem, can be brought together again and the machine side not affected continues production during the period in which the problem exists. Preferably, the rotational speeds of the motors can be reduced before and during an engagement and disengagement process. In some embodiments, the rotational speeds of the motors can be reduced to zero before and during an engagement and disengagement process.

In certain embodiments, the couplings are activatable in pulsed manner for engagement and disengagement. Advantageously, the pulse and/or pause times for activation of the couplings are variable. Advantageously, the pulse and/or pause times for activation of the couplings are variable in dependence on the reduced rotational speeds of the motors.

In certain embodiments, the couplings used operate electromagnetically. In certain other embodiments, the couplings used operate pneumatically. In yet further embodiments, the couplings used operate hydraulically.

Any suitable motors can be used for the drives, for example, speed-controlled motors, or variable speed motors.

Advantageously, in the case of a double-head draw frame, a respective common variable speed drive motor is used for the individual functions.

Advantageously, the drive chains of the two drafting systems (sides) are connected to the drive motor via at least two controllable couplings.

Advantageously, the or each drive motor has two outputs. Preferably, one output is used to drive the one drafting system and the other output is used to drive the other drafting system.

The invention also provides an apparatus on a spinning preparation machine, e.g. a draw frame, flat card, combing machine or the like, in particular a double-head draw frame, having at least two driven drafting systems for drafting in each case at least one fibre sliver with drafting rollers forming drafting roller pairs, having force-transmitting means for driving the drafting rollers and at least one drive motor, an electrically operable coupling being present between a drive motor and a drive shaft, wherein the particular drive chains are connected via a respective controllable coupling to the motor and the rotational speed of the motor can be reduced for the engagement and disengagement process.

DETAILED DESCRIPTION OF CERTAIN PREFERRED EMBODIMENTS

Figure 1:
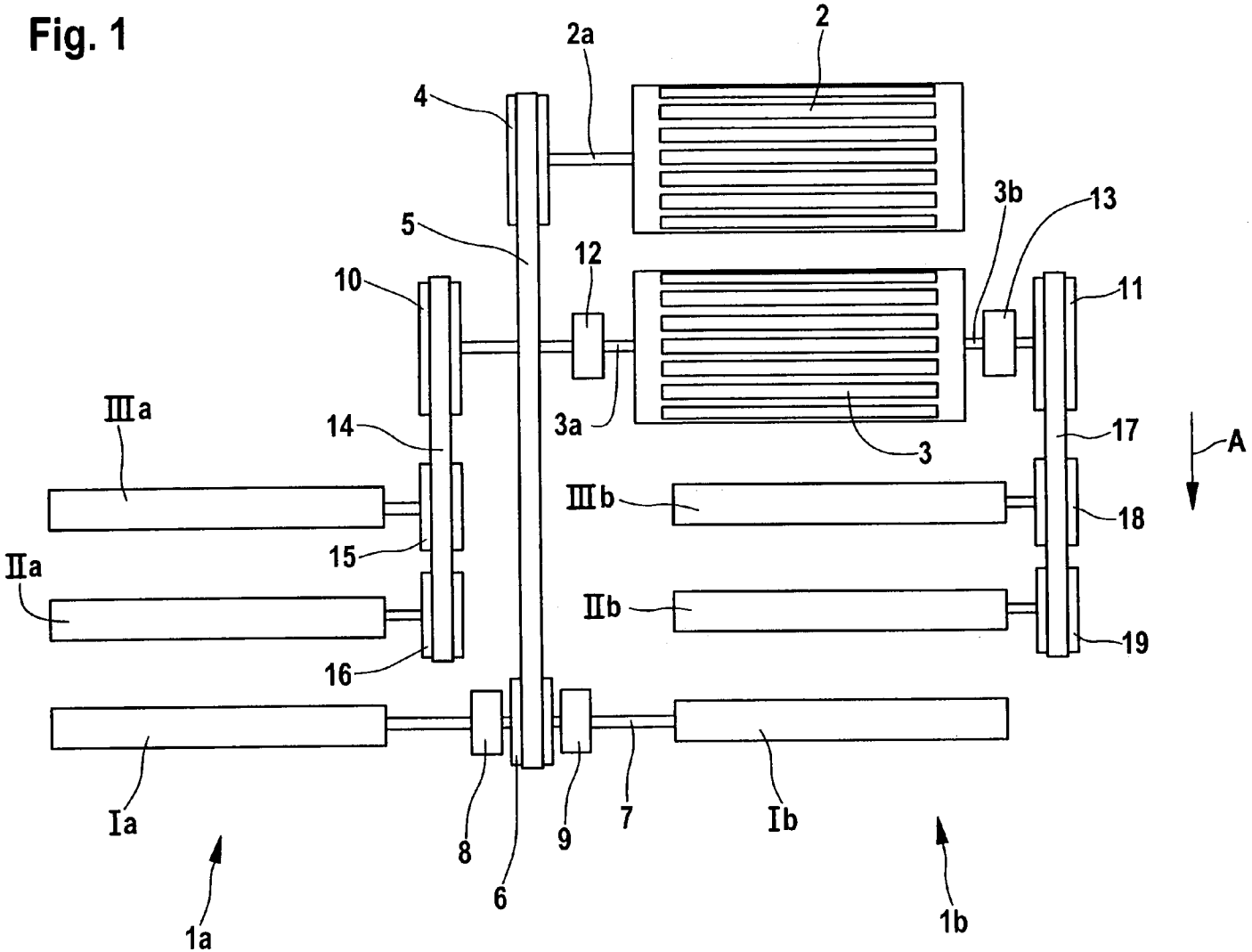
FIG. 1 is a schematic plan view of the transmission plan of a double-head draw frame having the apparatus according to an invention.

With reference to FIG. 1, in a double head draw frame having a drive arrangement according to a first embodiment of the invention, the transmission layout of two drafting systems Ia, Ib of a double-head draw frame has connections between two electric drive motors 2 and 3 and the drafting system bottom rolls Ia, IIa, IIIa and Ib, IIb, IIIb respectively. The drafting system bottom rolls Ia, IIa, IIIa and Ib, IIb, IIIb in particular are driven by toothed belts. Rotation of the drafting system top rolls (see FIG. 7) is effected by contact pressure of the top rolls on the bottom rolls.

A driving pulley 4 is mounted non-rotatably on the shaft extension 2*a* of the motor 2 (main motor), and is connected by means of a continuously revolving toothed belt 5 to the driven pulley 6, which is arranged non-rotatably on the main shaft 7. The main shaft 7 drives the two bottom rolls Ia and Ib coaxially. An electromagnetic coupling 8 is arranged between the pulley 6 and the bottom roll Ia and an electromagnetic coupling 9 is arranged between the pulley and the bottom roll Ib.

The motor 3 (variable-speed motor) has a rotating drive shaft, which forms the two shaft extensions 3*a*, 3*b* (shaft ends) projecting beyond the two end faces. Driving pulleys 10 and 11 are mounted non-rotatably on the shaft extensions 3*a* and 3*b* respectively. An electromagnetic coupling 12 is arranged between the motor 3 and the pulley 10 and an electromagnetic coupling 13 is arranged between the motor 3 and the pulley 11. The driving pulley 10 is connected by means of a continuously revolving toothed belt 14 to the driven pulleys 15 and 16 for the bottom rolls IIIa and IIa respectively. The driving pulley 11 is connected by means of a continuously revolving toothed belt 17 to the driven pulleys 18 and 19 for the bottom rolls IIIb and IIb respectively. The letter A denotes the direction of working for the two drafting systems 1*a* and 1*b*.

The drive chains—in the example of FIG. 1, four drive chains—are connected in the described manner to the motor 2 and 3 via a respective controllable coupling 8, 9, 12 and 13. The rotational speed of the motors 2 and 3 can be reduced for the engagement and disengagement procedure.

Thus, in a double-head draw frame, in each case a common variable-speed drive motor 3 is used for the individual functions. The drive chains of the left-hand and right-hand side (i.e. for the two drawing heads) are each connected via two controllable couplings 8 and 12, and 9 and 13, respectively, to the motors 2 and 3. This enables one side of the machine to be shut down (disengaged), if required, yet production to be continued with the other side.

Figure 2:
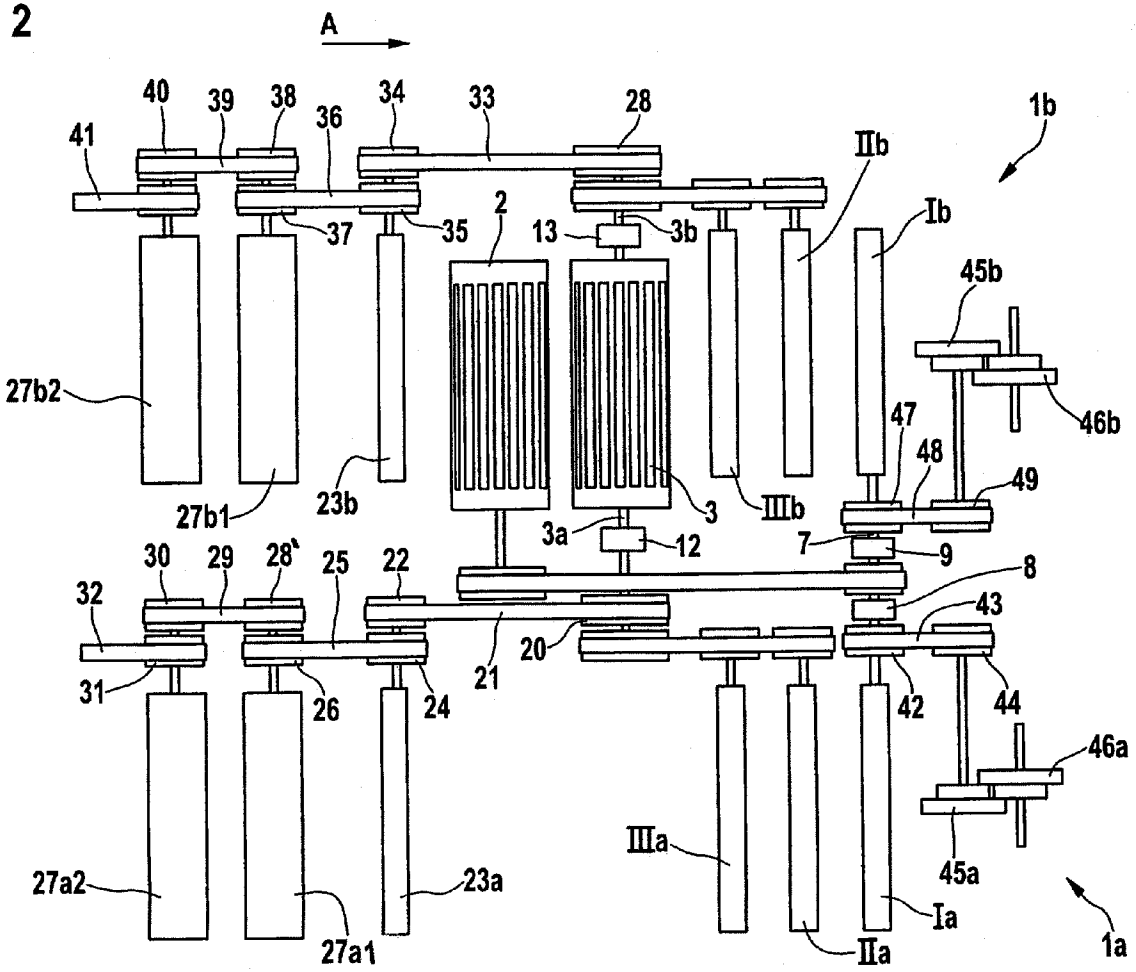
FIG. 2 is a schematic plan view of a transmission layout similar to FIG. 1, but with the drive of the rider rolls, the creel rolls and the delivery rolls for both sides.

FIG. 2 shows a transmission layout as in FIG. 1, additionally showing the drive of rider rolls, creel rolls and delivery rolls. A further driving pulley 20 is non-rotatably arranged on the shaft extension 3*a* and is connected by means of a continuously revolving toothed belt 21 to a driven pulley 22 for the rider roll 23*a*. A driving pulley 24 is mounted coaxially on the shaft for the rider roll 23*a* and is connected by means of a toothed belt 25 to a driven pulley 26 for a creel roll 27*a*2. Further creel rolls (not shown) arranged axially parallel are driven via further pulleys (i.e., 28', 30, and 31) and toothed belts (i.e., 29 and 32). A further driving pulley 28 is non-rotatably arranged on the shaft extension 3*b*, and—in a corresponding manner as explained for the rider roll 23*a* and the creel rolls 27*a*1, 27*a*2—drives the rider roll 23*b* and the creel rolls 27*b*1, 27*b*2 via pulleys 34, 35, 37, 38, 40 and toothed belts 33, 36, 39 and 41.

A further driving pulley 42 is non-rotatably arranged on the main shaft 7 and is connected by means of a continuously revolving toothed belt 43 to the driven pulley 44 for the take-off roll 45*a*, which co-operates with the take-off roll 46*a*. Yet a further driving pulley 47 is non-rotatably arranged on the main shaft 7 and,—in a corresponding manner as explained for the take-off rolls 45*a*, 46*a*—drives the co-operating take-off rolls 45*b*, 46*b* via pulleys 47, 49 and a toothed belt 48.

In the illustrative embodiment of FIG. 2, the drive trains are constituted as follows:

B from the motor 2 to the bottom roll Ia and the take-off rolls 45*a*, 46*a* (drawing head 1*a*), C from the motor 2 to the bottom roll Ib and the take-off rolls 46*a*, 46*b* (drawing head 1*b*), D from the motor 3 to the bottom rolls IIa, IIIa, the rider roll 23*a* and the creel rolls 27*a*1, 27*a*2, E from the motor 3 to the bottom rolls IIb, IIIb, the rider roll 23*b* and the creel rolls 27*b*1, 27*b*2.

In FIGS. 3*a* to 3*e*, an illustrative example of the course of the rotational speed of the motor and the rotational speed of the left-hand and right-hand drive chain on the occurrence of a fault is shown.

As required, one side of the machine, i.e. one drawing head 1*a* or 1*b*—is shut down (disengaged), and production is continued with the other side of the machine, which is not shut down (engaged). In order to achieve a relatively smooth transition upon engagement and disengagement, the rotational speed of the motor is automatically reduced for this operation and then accelerated again (see FIGS. 3*a* to 3*e* and FIG. 4).

The concept of reducing the rotational speed of the drive motor specifically for the engagement and disengagement process is based on the fact that a relatively smooth and predetermined speed transition can be achieved in this way. This applies especially to re-engagement. An example will explain this process in more detail.

The machine produces sliver at a speed of 600 m/min. A drawing head 1*a* or 1*b* has a fault. The speed is specifically reduced to 50 m/min, e.g. after a predetermined ramp. The drive of the faulty drawing head is disengaged and runs down to a standstill. This procedure is reduced to a reasonable minimum by the preceding and specific reduction in rotational speed. The delivery speed is again increased to 600 m/min. After correcting the fault, this is signalled (using a key), e.g. by the operator. The speed is reduced to 50 m/min, the coupling engages and the speed is again increased to 500 m/min (see FIGS. 3*a* to 3*e* and FIG. 4).

Figure 5A:
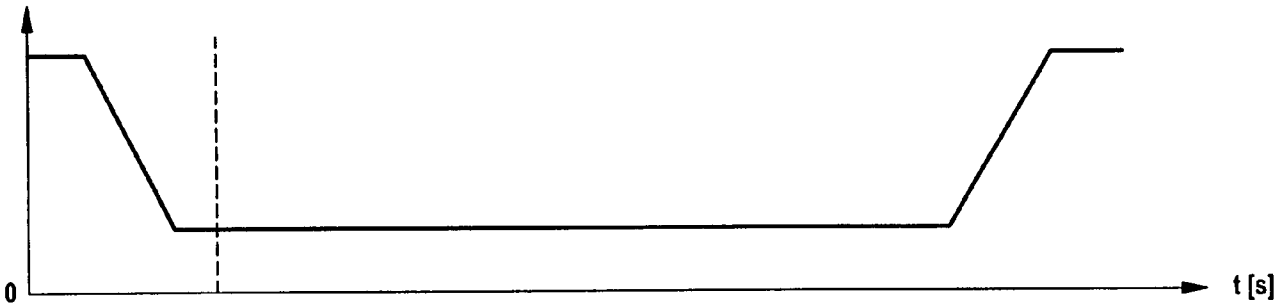
FIGS. 5*a* to 5*c* are graphical illustrations of a pulsed activation of the coupling.

If the re-engagement process were to take place at full delivery speed, then the speed of the disengaged drawing head would accelerate more or less abruptly from 0 to 600 m/min. This would certainly result in tearing of the incoming or exiting sliver. The advantage of this measure is to produce a specific speed transition that is as smooth as possible. This advantage is achieved even more effectively by a pulsed activation of the coupling (see FIGS. 5*a* to 5*c*).

If just one coupling were to be to be used, then an aim might have been to increase the productivity or efficiency of a double-head draw frame, but a simultaneous speed reduction would not have come into consideration. With just one coupling, only one drawing head can be isolated from the drive branch. This means that in the event of a fault in the drawing head, which cannot be isolated on the drive side, the whole machine must nevertheless be shut down and this in turn has a negative effect on the efficiency.

Figure 3A:
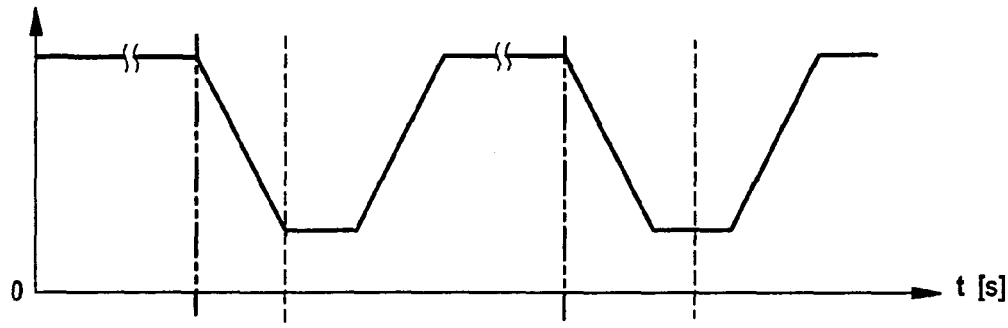
FIGS. 3*a* to 3*e* are graphical examples for the course of the rotational speed of the motor and the rotational speed of the left-hand and right-hand drive chain when a fault occurs.
Figure 3B:
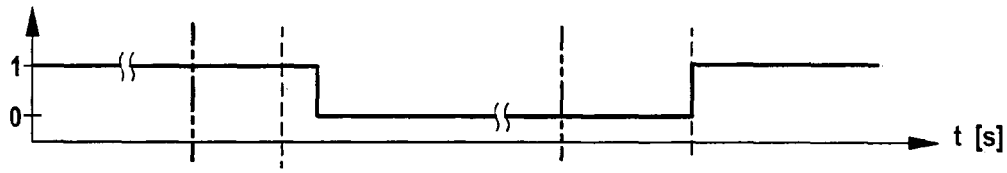
Figure 3C:
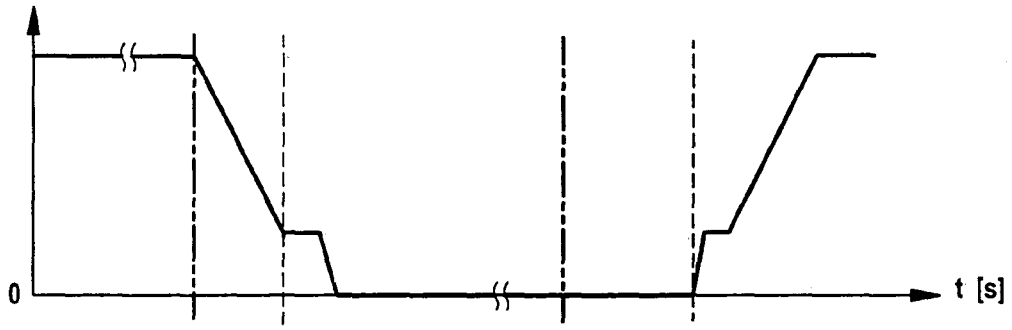
Figure 3D:
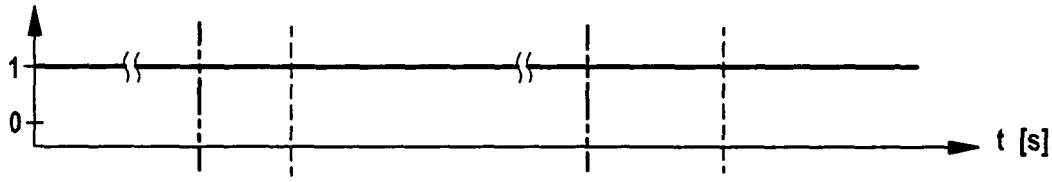
Figure 3E:
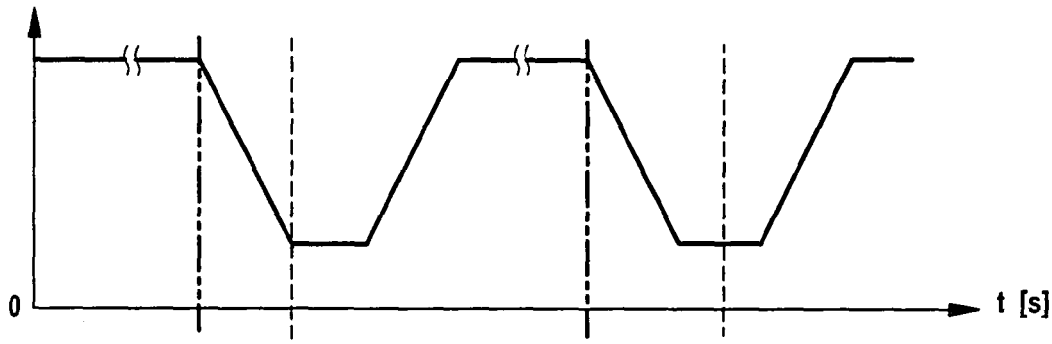
Figure 4:
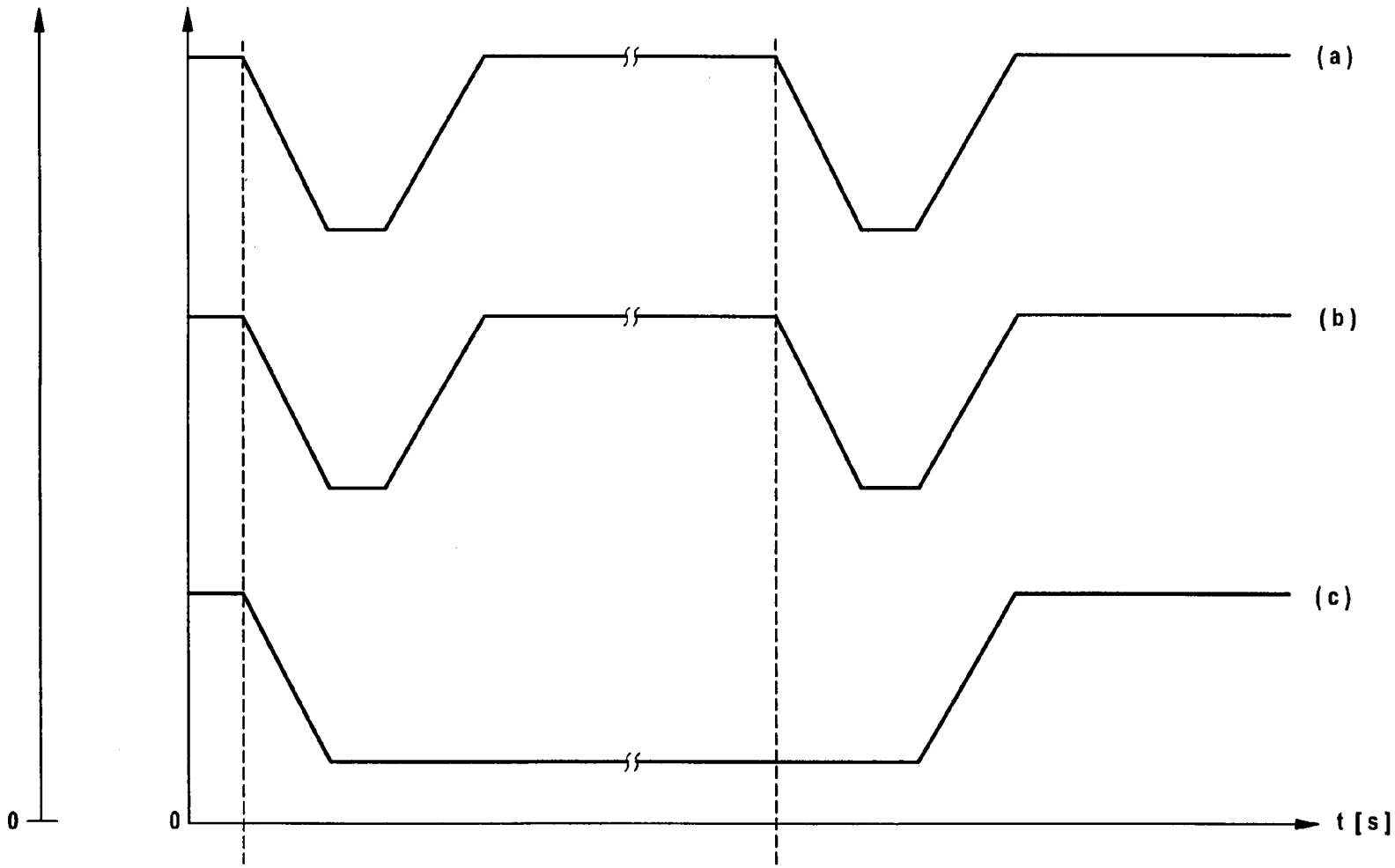
FIG. 4 is a graphical example of the course of the rotational speed of the motor and the delivery speed of the right-hand and left-hand drive sides when a fault occurs and after elimination thereof.
Figure 5B:
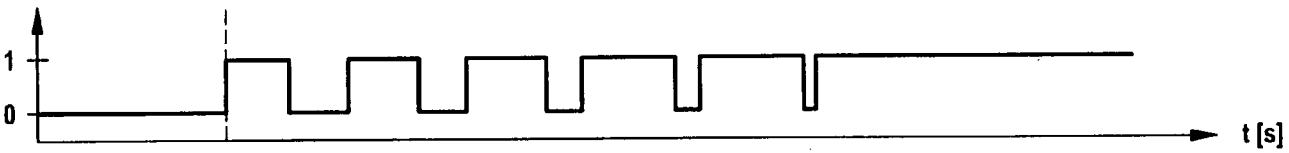
Figure 5C:
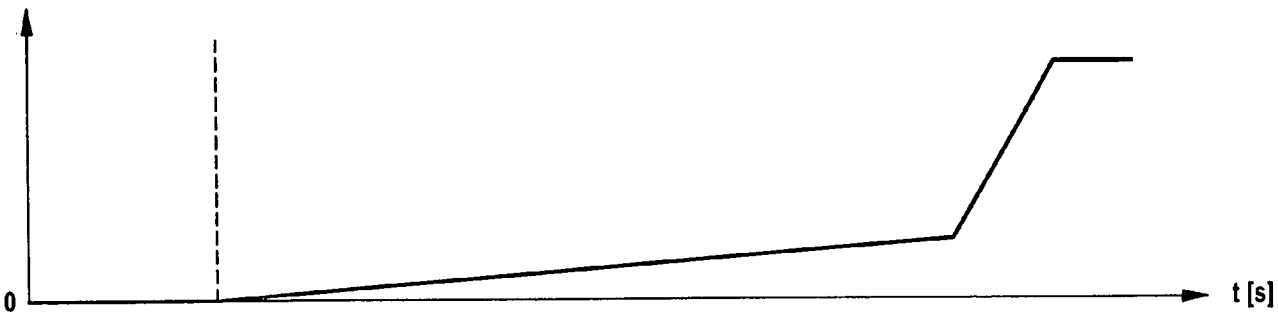

In the graphs of FIGS. 3*b*, 3*d* and 5*b*, a disengaged coupling is marked with "0" and an engaged coupling is marked with "1" on the ordinate. In the graphs of FIG. 4—in each case as a function of time t in seconds—(a) denotes the rotational speed of the motor in revolutions per minute, (b) denotes the delivery speed on the left-hand side in meters per minute and (c) denotes the delivery speed on the right-hand side in meters per minute.

Figure 6:
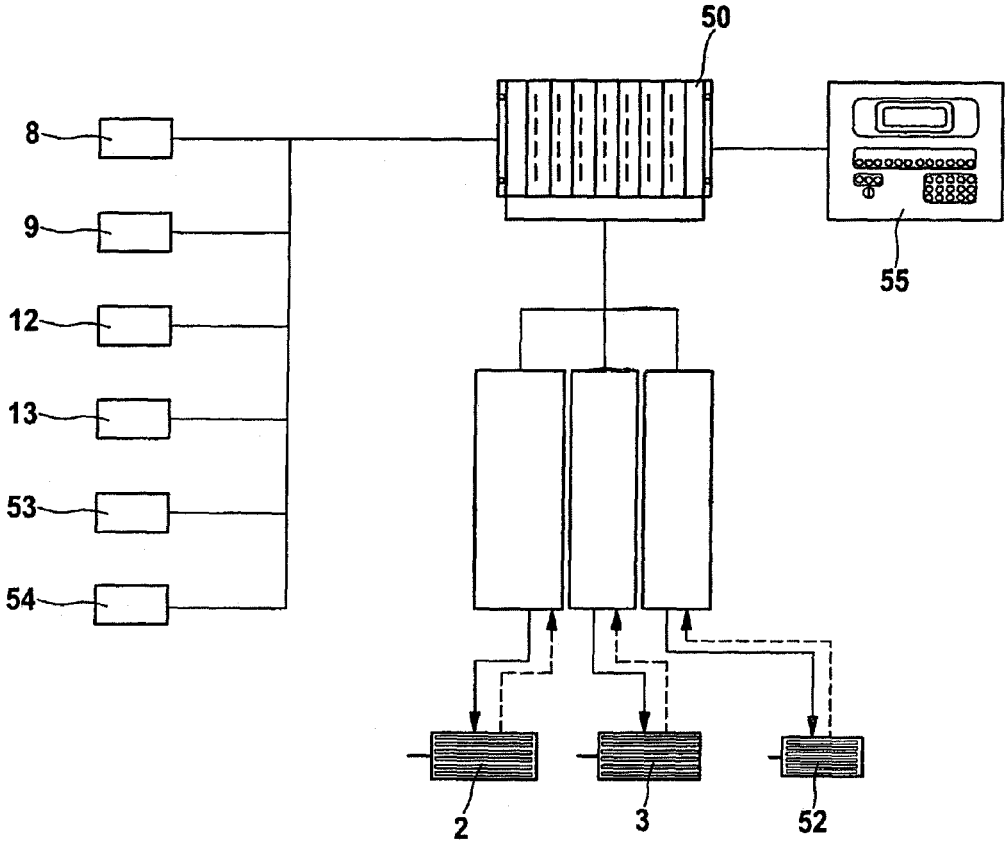
FIG. 6 is a schematic block diagram of a control concept for the apparatus according to the invention.

With reference to FIG. 6, one illustrative control concept for the apparatus according to the invention comprises a control system 50, e.g. the TMS-2 control system made by Trützschler GmbH & Co KG of Mönchengladbach, Germany. The control system 50 contains, e.g. a microcomputer. The motor 2 (main motor), the motor 3 (servomotor) and a motor 52 for driving a can turntable (not shown) are connected to the control system 50. The following electromagnetic couplings are furthermore connected to the control system 50:

- 8 for front rolls Ia/62*a*, 63*a* and delivery rolls 45*a*, 46*a* on the left-hand side (drawing head 1*a*),
- 9 for front rolls Ib/62*b*, 63*b* and delivery rolls 45*b*, 46*b* on the right-hand side (drawing head 1*b*),
- 12 for feed rolls IIIa/65*a*, middle rolls IIa/64*a* and rider rolls 23*a* on the left-hand side,
- 13 for feed rolls IIIb/65*b*, middle rolls IIb/64*b* and rider rolls 23*b* on the right-hand side,
- 53 for can turntable (not shown) on the left-hand side,
- 54 for can turntable (not shown) on the right-hand side.

The reference numeral 55 denotes a display device that is connected to the control system 50.

Figure 7:
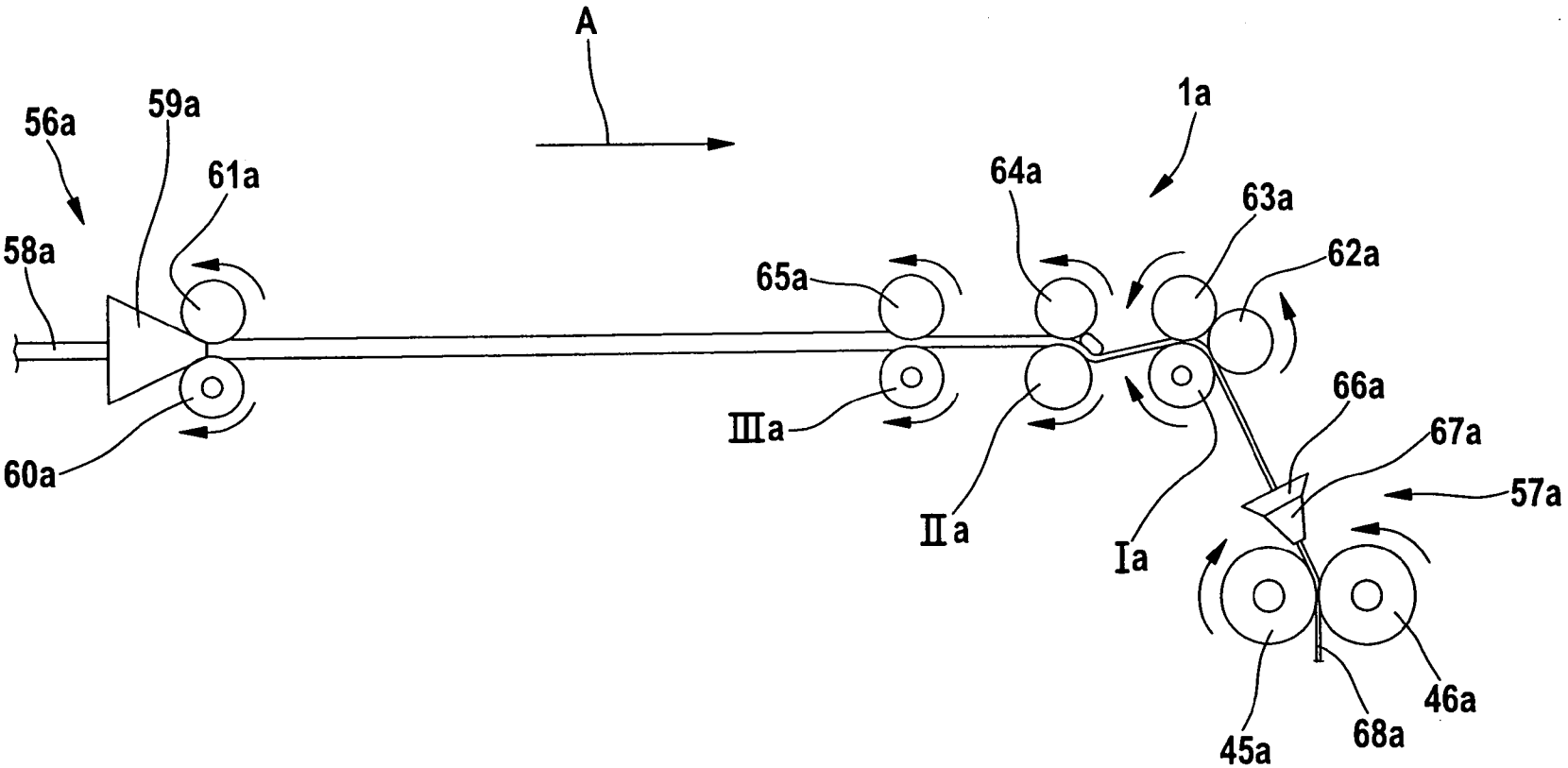
FIG. 7 is a schematic side view of a 4-over-3 drafting system with four top rolls and three bottom rolls at a draw head.

In FIG. 7, one side of the double-head drawframe is explained using the example of the drawing head 1*a*. The other side is constructed in an identical manner.

A drafting system inlet 56*a* is located upstream of the drafting system 1*a* and a drafting system outlet 57*a* is located downstream of the drafting system 1*a*. The fibre slivers 58*a*, coming from cans (not shown) or from canless fibre sliver packages, enter a sliver guide 59*a*, are drawn off by take-off rollers 60*a*, 61*a* and are transported onwards in direction A. The drafting system 1*a* is designed as a 4-over-3 drafting system, that is, it consists of three bottom rolls Ia, IIa, IIIa (Ia being the bottom delivery roll, IIa being the middle bottom roll and IIIa being the bottom feed roll) and four top rolls 62*a*, 63*a*, 64*a*, 65*a*. Diameters chosen for the bottom delivery rolls Ia may be, for example, 40 mm, for the middle bottom rolls IIa, 35 mm and for the bottom feed roll IIIa, 35 mm. The bottom rolls Ia, IIa and IIIa have a helical grooving. Drafting of the fibre sliver comprising several fibre slivers 58*a* takes place in the drafting system 1*a*. The draft is made up of the preliminary draft and the main draft. The roll pairs 65*a*/IIIa and 64*a*/IIa form the preliminary draft zone and the roll pairs 64*a*/IIa and 62*a*,63*a*/Ia form the main draft zone. The drawn fibre slivers reach a web guide 66*a* at the drafting system outlet 57*a* and are drawn by means of the take-off rolls 45*a*, 46*a* through a sliver funnel 67*a*, in which they are condensed to a fibre sliver 68*a*, which is subsequently deposited (not illustrated) in cans or as a canless sliver package. The letter A denotes the working direction. The exit speed of the fibre sliver 68*a* is for example, 1200 m/min and more. The direction of rotation of the rolls is indicated by curved arrows.

The apparatus of the invention can be applied to virtually all drive configurations. This applies to double-head draw frames with just a single motor, to those with a main motor and a servomotor or to draw frames with a main motor and a variable speed gear mechanism (to produce the draft). Moreover, it can be used in the case of motors with and without rotational speed adjustment. In addition, combinations are possible, for example, variable-speed main motor and variable speed servomotor. The invention can also be used for the drive of the can turntable.

Although the foregoing invention has been described in detail by way of illustration and example for purposes of understanding, it will be obvious that changes and modifications may be practised within the scope of the appended claims.

What is claimed is:

1. An apparatus on a spinning preparation machine, having:

a first driven drafting system for drafting at least one fibre sliver with drafting rollers, and having at least one force-transmitting element for driving the drafting rollers of the first drafting system;

a second driven drafting system for drafting at least one fibre sliver with drafting rollers, and having at least one force-transmitting element for driving the drafting rollers of the second drafting system; and at least one drive motor;

wherein a force-transmitting element for the first drafting system and a force-transmitting element for the second drafting system are each connected via a respective separately controllable coupling to a said drive motor and the rotational speed of the motor can be reduced for selectively engaging and disengaging one of the separately controllable couplings.

2. An apparatus according to claim 1, in which, in the event of a problem in one of the first and second drafting systems, one or more corresponding drive train can be isolated from said motor by means of the respective coupling and, after correcting the problem, can be brought together again, the unaffected drafting system continuing production during the period in which the problem exists.

3. An apparatus according to claim 1, in which the rotational speeds of the motors can be reduced before and during an engagement and disengagement process.

4. An apparatus according to claim 1, in which the rotational speed of the motor can be reduced to zero before and during an engagement and disengagement process.

5. An apparatus according to claim 1, in which the couplings are activatable in pulsed manner for engagement and disengagement.

6. An apparatus according to claim 5, in which the pulse and/or pause times for activation of the couplings are variable.

7. An apparatus according to claim 6, in which the pulse and/or pause times for activation of the couplings are variable in dependence on the reduced rotational speeds of the motors.

8. An apparatus according to claim 1, comprising one or more couplings that operate electromagnetically.

9. An apparatus according to claim 1, comprising one or more couplings that operate pneumatically.

10. An apparatus according to claim 1, comprising one or more couplings that operate hydraulically.

11. An apparatus according to claim 1, in which there is at least one further drive motor, said further drive motor also being connected via respective couplings to said first and second drafting systems.

12. An apparatus according to claim 11, in which at least one of said motors is a speed-controlled motor.

13. Apparatus according to claim 11, in which at least one of said motors is a variable speed motor.

14. An apparatus according to claim 1, in which said first and second drafting systems are in a double-head draw frame, and at least one common variable speed drive motor is used for driving rollers of the first drafting system and rollers of the second drafting system.

15. An apparatus according to claim 14, further comprising a further common variable speed drive motor for driving further rollers of each of said first and second drafting systems.

16. An apparatus according to claim 1, in which the drive chains of the first drafting system are connected to the drive motor or motors via at least two controllable couplings and the drive chains of the second drafting system are connected to the drive motor or motors via at least two further controllable couplings.

17. An apparatus according to claim 1, in which the or each drive motor has two outputs.

18. An apparatus according to claim 17, in which one output is used to drive at least one roller of the first drafting system and the other output is used to drive at least one roller of the second drafting system.

19. An apparatus according to claim 1, comprising an electrically operable coupling between the drive motor and a drive shaft.

20. A method of operating a drafting apparatus having first and second driven drafting systems driven by at least one common drive motor, comprising reducing the speed of a said drive motor, disengaging a drive element of the first drafting system from the drive motor, increasing the speed of the drive motor, and continuing to drive the second drafting system during and subsequent to said disengagement of a drive element of the first drafting system.

* * * * *